US010591209B2

(12) United States Patent
Lochner

(10) Patent No.: US 10,591,209 B2
(45) Date of Patent: Mar. 17, 2020

(54) AIR SEPARATION PLANT, METHOD FOR OBTAINING A PRODUCT CONTAINING ARGON, AND METHOD FOR CREATING AN AIR SEPARATION PLANT

(71) Applicant: LINDE AKTIENGESELLSCHAFT, Munich (DE)

(72) Inventor: Stefan Lochner, Grafing (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 961 days.

(21) Appl. No.: 14/765,847

(22) PCT Filed: Mar. 5, 2014

(86) PCT No.: PCT/EP2014/000553
§ 371 (c)(1),
(2) Date: Aug. 5, 2015

(87) PCT Pub. No.: WO2014/135271
PCT Pub. Date: Sep. 12, 2014

(65) Prior Publication Data

US 2015/0369535 A1 Dec. 24, 2015

(30) Foreign Application Priority Data

Mar. 6, 2013 (EP) ..... 13001127

(51) Int. Cl.
*F25J 3/02* (2006.01)
*F25J 3/04* (2006.01)

(52) U.S. Cl.
CPC ..... *F25J 3/0285* (2013.01); *F25J 3/0409* (2013.01); *F25J 3/04048* (2013.01); (Continued)

(58) Field of Classification Search
CPC .. F25J 3/04654; F25J 3/04666; F25J 3/04703; F25J 3/04878
See application file for complete search history.

(56) References Cited

U.S. PATENT DOCUMENTS 5,724,835 A * 3/1998 Hine ..... F25J 3/04254 62/646
2001/0001364 A1 5/2001 Bruder et al.
(Continued)

FOREIGN PATENT DOCUMENTS

FR 2964451 A3 3/2012

*Primary Examiner* — Keith M Raymond
*Assistant Examiner* — Nael N Babaa
(74) *Attorney, Agent, or Firm* — Millen White Zelano & Branigan, PC

(57) ABSTRACT

An air separation plant for obtaining product containing argon by low temperature separation of compressed, cooled feed air. The air separation plant comprises a high-pressure column, a multi-part low-pressure column having a base segment and a head segment and a multi-part crude argon column having a base segment and a head segment. An oxygen-enriched flow is obtained from part of the feed air in the high pressure column, an argon-enriched flow is obtained from part of the oxygen-enriched flow in the low-pressure column, and an argon-rich flow is obtained from part of the argon-enriched flow in the crude argon column. Liquid flow is transferred from a lower region of the head segment of the low-pressure column and from a lower region of the base segment of the crude argon column into an upper region of the base segment of the low-pressure column.

22 Claims, 2 Drawing Sheets

(52) U.S. Cl.
CPC ..... *F25J 3/0489* (2013.01); *F25J 3/04412* (2013.01); *F25J 3/04424* (2013.01); *F25J 3/04624* (2013.01); *F25J 3/04654* (2013.01); *F25J 3/04666* (2013.01); *F25J 3/04678* (2013.01); *F25J 3/04703* (2013.01); *F25J 3/04727* (2013.01); *F25J 3/04872* (2013.01); *F25J 3/04878* (2013.01); *F25J 2235/02* (2013.01); *F25J 2235/52* (2013.01); *F25J 2235/58* (2013.01)

(56) References Cited

U.S. PATENT DOCUMENTS

| | | | | |
|---|---|---|---|---|
| 2002/0029587 | A1* | 3/2002 | Pompl | F25J 3/0409 62/646 |
| 2012/0125045 | A1* | 5/2012 | Howard | F25J 3/0409 62/644 |

* cited by examiner

AIR SEPARATION PLANT, METHOD FOR OBTAINING A PRODUCT CONTAINING ARGON, AND METHOD FOR CREATING AN AIR SEPARATION PLANT

The present invention relates to an air separation plant, a method for obtaining an argon product by low-temperature separation of air, and a method for generating a corresponding air separation plant.

PRIOR ART

Obtaining argon by low-temperature separation of air is described, for example, in the article "Noble Gases" in Ullmann's Encyclopedia of Industrial Chemistry (doi: 10.1002/14356007.a17_485). As explained there, for example in FIG. 18, argon can be obtained in customary air separation plants having known twin-column systems for nitrogen-oxygen separation and an additional argon production unit.

In such twin-column systems, argon accumulates in the region of what is termed the argon transition in the low-pressure column (also termed argon bubble) and there reaches concentrations in the gas phase of up to 15%. In practical use, an argon-enriched stream is taken off from the low-pressure column somewhat below this argon maximum, in order that said stream has a lower nitrogen content.

The argon-enriched stream is transferred to what is termed a crude argon column. The crude argon column is a separation column for argon-oxygen separation. In customary air separation plants, the crude argon column can be formed by a one-piece column, but two- or multipiece columns are also described, for example in BP 0 628 777 B1.

An argon-enriched stream having an argon content of, for example, 10% is fed into known crude argon columns. In the crude argon column, an argon-rich stream is obtained therefrom which can be further purified in a downstream pure argon column. In the pure argon column, an argon product having a content of up to 99.9999% argon or more can be obtained. This argon product is usually obtained in liquid form, in order to facilitate storage and transport.

Processes of the type described for obtaining argon are known, for example, from the following documents: DE 2 325 422 A, EP 0 171 711 A2, EP 0 377 117B2 (corresponds to U.S. Pat. No. 5,019,145 A), DE 403 07 49 A1, EP 0 628 777 B1 (U.S. Pat. No. 5,426,946 A), EP 0 669 508 A1 (U.S. Pat. No. 5,592,833 A), EP 0 669 509 B1 (U.S. Pat. No. 5,590,544 A). EP 0 942 246 A2, EP 1 103 772 A1, DE 196 09 490 A1 (U.S. Pat. No. 5,669,237 A), EP 1 243 882 A1 (US 2002/178747 A1), EP 1 243 881 A1 (US 2002/189281 A1) and FR 2 964 451 A3.

When air separation plants are being generated for argon production, problems result on account of the dimensions of the columns used, in particular of the crude argon column. A twin-column system for nitrogen-oxygen separation can achieve in total a height of almost 60 m; a crude argon column in a one-piece form is likewise in the same region.

Corresponding air separation plants are scarcely prefabricatable any longer, because the respective component groups can generally no longer be transported over relatively long sections. This means that they have to be erected at the respective target site. This is disadvantageous for various reasons, inter alia, because corresponding staff at the target site are either not available or expensive. The expenditure for generating corresponding air separation plants increases significantly thereby.

In contrast, the substantially modularized generation of a corresponding air separation plant at the site of fabrication is desirable. The individual components are accommodated there, preferably already in the corresponding cold boxes, and only need to be connected to one another at the target site. For this purpose, advantageously, likewise modules, what are termed piping skids, can be used.

US 2001/0001364 A1 proposes constructing some of the columns of an air separation plant for obtaining argon in a two-piece manner and implementing an arrangement which permits reducing the size of a cold box for said columns.

Although this segmentation facilitates the generation of air separation plants, there is still the need for improvements. The object of the invention is therefore to generate and operate an air separation plant of the type mentioned at the outset in a particularly favorable manner economically.

DISCLOSURE OF THE INVENTION

Against this background, the present invention proposes an air separation plant, a method for obtaining an argon product by low-temperature separation of air, and a method for generating a corresponding air separation plant having the features described herein. Preferred embodiments are likewise subject matter of the description hereinafter.

Advantages of the Invention

According to the invention, an air separation plant is proposed which is designed for obtaining an argon-containing product by low-temperature separation of compressed and cooled feed air. The air separation plant has a high-pressure column, a low-pressure column which is constructed in a multi-part manner and a crude argon column which is constructed in a multi-part manner. The low-pressure column which is constructed in a multi-part manner and the crude argon column which is constructed in a multi-part manner each have at least one foot section and a top section arranged spatially separate therefrom. In particular, the low-pressure column constructed in a multi-part manner and the crude argon column constructed in a multi-part manner are each constructed in a two-part manner.

The air separation plant operates on the basis of the principles explained at the outset, wherein an argon-enriched stream can be withdrawn from the low-pressure column of the air separation plant.

The "argon-containing product" can be for example, liquid argon (LAR), gaseous argon (GAR, optionally obtained by what is termed internal compression) or what is termed fake argon (impure argon which is added to a residual gas gaseous in the cold state). The invention will be explained hereinafter predominantly by the example of liquid pure argon (LAR), which is termed "argon product" for short.

A column "constructed in a two-part manner" is constructed, as mentioned, in such a manner that the two sections (top section and foot section) are arrangeable spatially separate from one another. Known air separation plants can have, for example, column systems for nitrogen-oxygen separation in which the high-pressure column and the low-pressure column are arranged separate from one another and are heat-exchangingly connected via an overhead condenser. Such column systems are "constructed in a two-part manner". The expression "constructed in a two-part manner" therefore delimits corresponding configurations from structural units in which components are permanently connected to one another and are not arrangeable separate from one another.

"Foot section" and "top section" each denote the sections of columns constructed in a two-part manner which correspond in function thereof, in particular with respect to the fractions or streams arising there, to the lowest or topmost sections of customary columns constructed in a one-part manner. A foot section has, for example, a sump container; a top section has, for example, an overhead condenser. The top section is therefore the part of the columns which is connected to a corresponding condenser, and in which a return is applied to the corresponding columns. In a low-pressure column constructed in a one-part manner of known air separation plants, in the sump, an oxygen-rich liquid fraction is obtained which can be taken off as an oxygen product. This also proceeds thereby in a sump of a foot section of a low-pressure column constructed in a two-part manner. At the top of a low-pressure column constructed in a one-part manner of known air separation plants, correspondingly a gaseous nitrogen product can be taken off, and the same applies to the upper part of a top section of a low-pressure column constructed in a two-part manner. At the top of a crude argon column constructed in a one-part manner—and correspondingly at the upper part of a top section of a crude argon column constructed in a two-part manner—a crude argon stream is taken off and transferred to a pure argon column, from the sump of a crude argon column constructed in a one-part manner—and correspondingly from the sump of a foot section of a crude argon column constructed in a two-part manner—the sump product that arises is fed back to the low-pressure column.

If a low-pressure and/or crude argon column, constructed in a "multi-part" manner, has more than two parts, in addition intermediate sections between toot section and top section are provided. The individual sections (foot, top and optionally intermediate sections) are connected to one another by means of lines and optionally pumps, in order in this manner to provide an operation as also proceeds in the case of a respectively one-piece column.

The air separation plant according to the invention is configured in a familiar manner which means that, in the high-pressure column, at least one oxygen-rich stream is obtainable from at least a part of feed air, which can be provided, for example, in the form of a plurality of feed air streams. The oxygen-rich stream can be at least in part transferred to the multipiece low-pressure column, more precisely first into the foot section thereof. In the multipiece low-pressure column, as explained, at what is termed the argon transfer, from at least a part of the oxygen-enriched stream, at least one argon-rich stream can be obtained. This can be transferred to the multipiece crude argon column, more precisely first likewise to the foot section thereof. In the crude argon column at least from a part of the argon-enriched stream, at least one argon-rich stream can be obtained.

The expressions "streams" and "fractions" are used for corresponding fluids. A "stream" is, for example, a fluid that is conducted continuously into a corresponding line. A "fraction" is a proportion of a starting mixture, for example air, which can be separated off from the starting mixture. Such a fraction can be conducted at any time as a stream in a corresponding line system or in a column.

A stream or a fraction can be "enriched" with respect to one or more components present, wherein an enriched fraction or an enriched stream has a higher content of one or more correspondingly designated components than the starting mixture. In particular, an enrichment exists when the content corresponds to at least two, five, ten or one hundred times the corresponding content in the starting mixture. A stream that is "rich" with respect to one or more components predominantly has the corresponding component(s). For example, an argon-rich stream can have at least 80%, 90%, 95% or 99% argon on a molar, weight or volume basis.

The air separation plant according to the invention is distinguished in that at least one liquid stream from a lower region of the top section of the low-pressure column, and from a lower region of the foot section of the crude argon column is transferrable by means of a shared pump into an upper region of the toot section of the low-pressure column.

The invention can comprise different arrangements of the columns or of the sections thereof. For instance, the foot section and/or the top section of the crude argon column can be arranged geodetically at least in part next to the top section of the low-pressure column. In this case, the high-pressure column, the top section of the low-pressure column, the foot section and the top section of the crude argon column can also be arranged geodetically at least in part adjacent to one another. According to a further embodiment, it is provided that the foot section or the top section of the crude argon column is arranged geodetically completely above the top section of the low-pressure column, Preferably, the toot section of the low-pressure column is also arranged in vertical plan view next to the top section thereof and the foot section of the crude argon column is also arranged in vertical plan view next to the top section thereof. At the same time, when the foot section or the top section of the crude argon column is arranged geodetically completely above the top section of the low-pressure column, the high-pressure column and the foot section of the low-pressure column on the one hand and the top section or the foot section of the crude argon column and the top section of the low-pressure column are arranged in vertical plan view at least in part one above the other.

In the context of the present application, "geodetically at least in part next to" means that the lowest point of the column or column section respectively identified more closely (here, for example, the foot section and/or the top section of the crude argon column) is situated beneath the highest point of the corresponding other column or column section (here, for example, the top section of the low-pressure column). The lowest points of the columns or column sections respectively identified more closely can also be situated on one plane. In the embodiment mentioned, in which the foot section and/or the top section of the crude argon column is arranged geodetically at least in part next to the top section of the low-pressure column, therefore, a horizontal sectional plane exists which intersects not only the foot section and/or the top section of the crude argon column, but also the top section of the low-pressure column.

Correspondingly, "geodetically completely above" means that the lowest point of the column or column section respectively identified more closely (here, tor example, the foot section or the top section of the crude argon column) is situated above the highest point of the corresponding other column or of the column section (here, tor example, the top section of the low-pressure column). If in the case described the loot section or the top section of the crude argon column which is arranged geodetically completely above the top section of the low-pressure column would be fluidically connected at the lowest point thereof to the top section of the low-pressure column, a liquid, ignoring pressure differences, would drain completely into the top section of the low-pressure column.

In this case the "lowest point" of a column or of a column section is in each case the lowest point at the bottom of a container arranged on the bottom side, for example a sump container, or the entire interior of the column or the column section. The lines that may be connected hereto are not considered to be part of the column. The "highest point" of a column or of a column section is the roof of the column or of a column section. If a column or a column section has an overhead condenser, the highest point thereof is the highest point of the column or of the column section.

An arrangement of a component "next to in vertical plan view" here means an arrangement in which the corresponding components are arranged adjacently in a vertical projection. This does not exclude the corresponding elements from being arranged at different (geodetic) heights to one another. For example, the foot section of the low-pressure column can be arranged in vertical plan view next to the top section of the low-pressure column, but the arrangement with respect to height can be different in such a manner that the geodetically highest point of the top section of the low-pressure column is still situated beneath the geodetically lowest point of the foot section of the low-pressure column. If, in contrast, the components are arranged "in vertical plan view at least in part one above the other", the peripheral lines thereof overlap at least in part. For example, a crude argon container can be shifted sideways in order to give a more space-saving construction.

The arrangement according to the invention in the embodiments mentioned proves to be particularly advantageous, because corresponding air separation plants can hereby be erected with markedly lower height. For example, by means of the measures according to the invention, an air separation plant can be erected with a crude argon column having an effective height of approximately 60 m by a corresponding separation and arrangement in a total structural height of approximately 40 m.

The crude argon column of said height for this purpose is subdivided into, for example, two parts. The top section of the low-pressure column which is likewise divided into two parts can be placed geodetically below the top section or foot section of the crude argon column in a shared cold box. This arrangement has a number of additional advantages which will be explained hereinafter. The foot section of the low-pressure column can form, together with the high-pressure column, a structural unit and as such likewise be placed in a corresponding cold box. The high-pressure column and the foot section of the low-pressure column can be heat-exchangingly connected to one another via a main condenser. This configuration corresponds to a conventional air separation plant with a Linde twin column.

The corresponding cold box for the top section or for the foot section of the crude argon column and the top section of the low-pressure column measures only approximately 40 m. The transport is thereby facilitated. The same applies to the cold box which contains the high-pressure column and the foot, section of the low-pressure column. The remaining section of the crude argon column likewise requires a structural height of approximately 40 m.

The air separation plant can therefore be erected, and, in particular on account of the mentioned pump arrangement according to the invention, operated, particularly inexpensively. In particular, such an air separation plant can be completely prefabricated at the fabrication site and transported to the target site in the corresponding cold boxes in the form of modular units. A complex connection of a multiplicity of components at the target site is therefore not necessary. The plant components can be examined for their functionality particularly simply in their totality in the factory, which optionally makes complex fault diagnosis on individual components at the target site unnecessary.

Particular advantages result during operation of the air separation plant according to the invention in that, as mentioned, a liquid stream from a lower region of the top section of the low-pressure column and a liquid stream from a lower region of the foot section of the crude argon column are transferrable by means of a shared pump into an upper region of the foot section of the low-pressure column. The provision of a plurality of different pumps and therefore a corresponding energy consumption and also the associated heat input and corresponding susceptibility to maintenance can be dispensed with completely hereby.

The low-pressure column in this case is preferably constructed and operated in such a manner that the argon transition mentioned is situated at the separation site between the top section and foot section of the low-pressure column. As mentioned, in practical application, an argon-enriched stream is taken off from the low-pressure column somewhat beneath the actual argon maximum, so that it has a lower nitrogen content. This can be taken into account in the selection of the separation site and during operation of the low-pressure-column. As a result, the streams from the lower region of the foot section of the crude argon column and from the lower region of the top section of the low-pressure column have the same or similar argon concentrations, in such a manner that they can be fed by means of the shared pump into the upper region of the foot section of the low-pressure column.

An air separation plant according to the invention can be erected in a differing configuration, in particular using what, are termed piping skids, that is to say using piping modules which also permit a prefabricated pipe connection.

In addition, the air separation plant according to the invention advantageously has a pure argon column in which argon may be obtained having a purity in the range mentioned at the outset. The pure argon column can be arranged in one of the cold boxes mentioned, or separately thereto, in particular in a separate cold box.

A method according to the invention comprises obtaining an argon product by low-temperature separation of compressed and cooled feed air. The method according to the invention profits from the abovementioned advantages, and so reference can be made explicitly thereto.

The invention will be described hereinafter with reference to the accompanying drawings which illustrate preferred embodiments of the invention.

EMBODIMENTS OF THE INVENTION

In the figures, elements corresponding to one another are given identical reference signs. Repeated explanation of the same is dispensed with.

Figure 1:
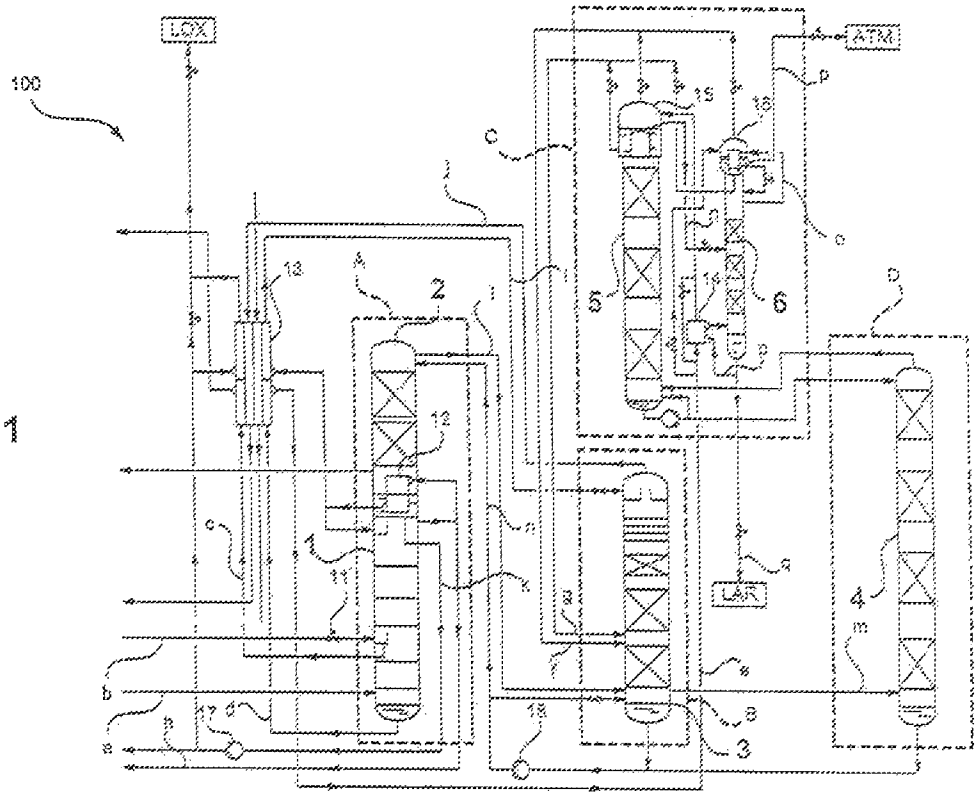
FIG. 1 shows schematically an air separation plant for obtaining an argon product according to a particularly preferred embodiment of the invention.
Figure 2:
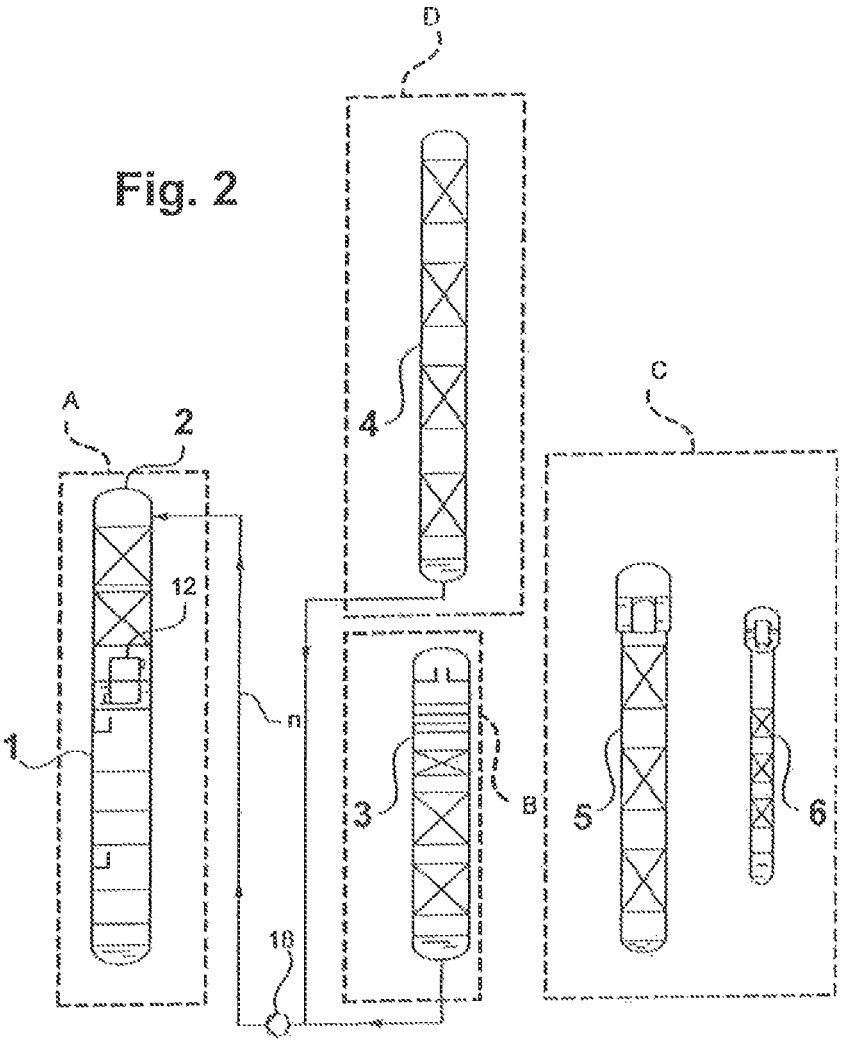
FIG. 2 shows schematically an air separation plant for obtaining an argon product according to a particularly preferred embodiment of the invention.

It is stressed explicitly that the arrangement of the components of the air separation plants shown in FIGS. 1 and 2 is only by way of example and that, in particular, the dimensions of the components shown there, in particular the columns, are not correct to scale. As mentioned, the crude argon column of a corresponding air separation plant generally has the greatest height, which is not reproduced correct to scale in the drawing. Also plants having what are termed dummy columns are known, from which only argon is taken off in order to achieve an energy advantage. Such columns are markedly lower, that is to say also lower than the other columns.

FIG. 1 shows schematically an air separation plant according to the invention for obtaining an argon product and which is denoted overall with 100. The air separation plant, as separation units, has a high-pressure column 1, a two-piece low-pressure column having a foot section 2 and a top section 3, an equally two-piece crude argon column having a toot section 4 and a top section 5, and also a pure argon column 6. The foot section 2 and the top section 3 of the low-pressure column are structurally separated from one another. The top section 3 of the low-pressure column is arranged in vertical plan view next to the high-pressure column 1, and the foot section 2 of the low-pressure column thereabove. The foot section 2 and the top section 3 of the low-pressure column correspond together functionally to a conventional low-pressure column of a Linde twin column. The high-pressure column 1 and the two column sections 2 and 3 of the low-pressure column therefore form a distillation column system for nitrogen-oxygen separation.

In the exemplary embodiments shown, cooled and compressed feed air is fed into the high-pressure column 1 in the form of two streams a and b. The streams a and b can be what is termed a turbine stream (stream a) on the one hand and what is termed a throttle stream (stream b) on the other. The air separation plant 100 according to the invention can therefore be constructed for internal compression. Providing the streams a and b is shown, for example, in EP 2 026 024 A1. For example, atmospheric air can be drawn in by suction via a filter from an air compressor and there be compressed to an absolute pressure from 5.0 to 7.0 bar, preferably about 5.5 bar. The air can be compressed to a higher pressure in the air compressor itself or in a further compressor (aftercompressor) arranged downstream therefrom and later expanded via an expansion engine, as a result of which, for example, some of the refrigeration requirement of the air separation plant 100 can be covered.

The air can be cooled after the compression, for example in a direct contact cooler in direct heat exchange with cooling water. The cooling water can be supplied, tor example, from an evaporative cooler and/or from an external source. The compressed and cooled air can then be purified in a purification device. This can have, for example, a pair of containers which are filled with a suitable adsorbent, preferably molecular sieve. The purified air is then generally cooled in a main heat exchanger to about dew point.

The operating pressures—in each case at the top or at the upper part of the top section—are 4.5 to 6.5 bar, preferably about 5.0 bar in the high-pressure column 1 and 1.2 to 1.7 bar, preferably about 1.3 bar, in the low-pressure column 2, 3. The foot section 2 and the top section 3 of the low-pressure column are preferably operated at substantially the same pressure, which, however, does not exclude certain pressure differences, for example owing to line resistances.

The high-pressure column 1 and the foot section 2 of the low-pressure column are in heat-exchange connection via a main condenser 12 and are constructed as a structural unit. However, the invention is fundamentally also usable in systems in which the high-pressure column 3 and the low-pressure column (or the foot section 2 thereof) are arranged separate from one another and have a separate main condenser, i.e. one which is not integrated into the columns.

Air which is liquefied when the feed air stream b is fed into the high-pressure column 1 can in part be removed as corresponding stream c, warmed in a subcooling counterflow heat exchanger 13 and then used in other ways or again compressed and provided as feed air stream a, b.

An oxygen-enriched fraction d is taken off from the sump of the high-pressure column 1, subcooled in the subcooling counterflow heat exchanger 13 and, as stream e, further cooled in part in a sump evaporator 14 of the pure argon column 6. Another part can bypass the sump evaporator 14. Part of the stream e flows into the evaporation chamber of an overhead condenser 15 of the top section 5 of the two-part crude argon column, another part into the evaporation space of an overhead condenser 16 of the pure argon column 6. The portion of the oxygen-enriched fraction that is vaporized in the overhead condensers 15 and 16 is fed as stream f to the top section 3 of the low-pressure column at a first intermediate point. The portions remaining liquid are applied as stream g at a second intermediate point of the top section 3 of the low-pressure column which is situated above the first intermediate point.

Gaseous nitrogen from the top of the high-pressure column 1 can be warmed, in part as stream h, for example in the main heat exchanger which is not shown, for cooling the feed air to about ambient temperature, and then, as shown in EP 2 026 024 A1, be treated further.

The residual gaseous nitrogen from the top of the high-pressure column 1 is at least partly condensed in the main condenser 12. The liquid nitrogen generated in the course of this operation is in part applied as reflux to the high-pressure column 1. Another part, after subcooling in the subcooling counterflow heat exchanger 13, is passed as stream i to the upper part of the top section 3 of the low-pressure column. A gaseous nitrogen stream j from the top of the top section 3 of the low-pressure column can, after passing through the subcooling counterflow heat exchanger 13, be utilized in a different manner, or reused in the air separation plant.

A liquid oxygen stream k from the sump of the foot section 2 of the low-pressure column can be pressurized in the liquid state by means of a pump 17 and then passed, for example, to a liquid oxygen tank (LOX). Some of this oxygen can also be vaporized for providing gaseous pressurized oxygen (what is termed internal compression).

The division of the low-pressure column into the foot section 2 and the top section 3 and operation thereof proceed in such a manner that, in the lower part of the top section 3 of the low-pressure column, an argon-enriched fraction accumulates, in this case this is the region of what is termed the argon transition (also designated argon bubble or argon section). This enrichment results, as is known to those skilled in the art, from the volatility of argon which lies between that of nitrogen and that of oxygen. If customary reflux ratios are used in the low-pressure column, the argon transition lies above and below the intermediate point at which an oxygen-enriched fraction is fed in (streams f and g). Argon concentrations of up to 15% in the vapor phase can be achieved. In order to reduce the nitrogen concentration, the argon-enriched stream, however, is usually taken off below this intermediate point, as is here the case (stream m).

In the air separation plant 100, a stream 1 flows from the upper part of the foot section 2 of the low-pressure column to the top section 3 of the low-pressure column in the lower region thereof as a result of which the foot section 2 and the top section 3 of the low-pressure column are in part functionally coupled. At the same height, from the top section 3 of the low-pressure column, an argon-rich stream m is taken off and fed into the foot section 4 of the crude argon column. The feed-in proceeds immediately above the sump of the foot section 4 of the crude argon column.

Sump liquid from the sump of the top section 3 of the low-pressure column and from the sump of the foot section 4 of the crude argon column is passed back via a pump 18 as stream n to the foot section 2 of the low-pressure column. As a result, firstly the functional coupling of the first column section 2 and of the second column section 3 of the low-pressure column is completed and, secondly, the crude argon column is incorporated into the separation system via the foot section 4.

The overhead condenser 15 of the top section 5 of the crude argon column can be constructed as a reflux condenser. Gas from the top end of the top section 5 of the crude argon column flows downwards into the reflux passages and is there partially condensed. The condensate that is generated as a result flows downwards in counterflow to the ascending gas in the reflux passages and is utilized in the top section 5 of the crude argon column as liquid reflux. On the evaporation side, the overhead condenser 15 is constructed as a bath condenser. The coolant fluid, which is formed here by the liquid oxygen-enriched fraction from the high-pressure column 1, flows downwards via one or more side openings into the evaporation passages and there in part vaporizes. The thermo siphon effect entrains liquid, which exits together with the vaporized portion at the upper end of the evaporation passages and is returned to the liquid bath. The overhead condenser 15 is therefore constructed on the evaporation side as a bath evaporator.

From the top end of the reflux passages, via a lateral header, a crude argon stream n is withdrawn in the gaseous state and passed to the pure argon column 6 at an intermediate site. The overhead condenser 16 of the pure argon column 6 is, in the example, conventionally constructed on the liquefaction side, i.e. an overhead gas stream o of the pure argon column 6 flows from top to bottom through the liquefaction passages. (Alternatively, the overhead condenser 16 of the pure argon column 6 and/or the main condenser 12 could also be constructed as reflux condensers.) A residual gas stream p is taken off from the overhead condenser 16 of the pure argon column 6 and blown off to atmosphere (ATM) in the example. Alternatively, it can be recirculated via a separate fan into the high-pressure column 1 or the low-pressure column 2, 3 and/or upstream of the air compressor.

The sump liquid of the pure argon column 6 is in part vaporized as stream p in the sump evaporator 14 and the vapor generated in this ease is utilized as ascending gas in the pure argon column 6. The remainder is withdrawn as liquid pure argon product stream q (LAR).

An exemplary integration of the components of the air separation plant 100 in corresponding cold boxes is shown in FIG. 1 by dashed lines. In this case, A denotes a first cold box which is designed for receiving the high-pressure column 1 and the foot section 2 of the low-pressure column. A second cold box B can be designed for receiving the top section 3 of the low-pressure column. In the example shown, a third cold box C is designed for receiving the top section 5 of the erode argon column. As explained, the top section 3 of the low-pressure column and the top section 5 of the high-pressure column (optionally together with the pure argon column 6) can also be arranged in a shared cold box. Such a cold box can have, for example, a height of 40 m. A fourth cold box D is shown reduced in the example given and, for example, likewise has a height of 40 m.

In FIG. 2, an air separation plant for obtaining an argon product according to a further embodiment of the invention is shown in a still more diagrammatic form. In this air separation plant, only the columns 2 to 6 are shown, and a depiction of the corresponding connections, pumps and heat exchangers has been substantially dispensed with. As can be seen, here, in contrast to the depiction of FIG. 1, a foot section 4 of the crude argon column is arranged above the top section 3 of the low-pressure column. In this alternative embodiment, the subdivision of the crude argon column can be performed at a site different from that shown in the figure, if this is expedient for the arrangement according to the invention. Here also, the advantage results that fluid from the foot, section 4 of the crude argon column and from the top section 3 of the low-pressure column can be pumped by means of the pump 18 as stream n into the foot section 3 of the low-pressure column. This also applies to arrangements that are provided as an alternative in which the foot section 4 and/or the top section 5 of the crude argon column is geodetically arranged at least in part next to the top section 3 of the low-pressure column. Also, all column sections 1 to 4 can be arranged at least in part geodetically adjacent to one another.

In all of the cases shown, via the choice of the internals in the respective columns (sieve trays, packings having differing density), the diameter of the columns can be correspondingly influenced and hereby optionally a further structural adaptation can be achieved.

The invention claimed is:

1. An air separation plant for producing an argon-containing product by low-temperature separation of compressed cooled feed air, said air separation plant comprising:

a high-pressure column, a low-pressure column constructed in a multi-piece manner having a foot section and a top section arranged spatially separate therefrom, and a crude argon column constructed in a multi-piece manner having a foot section and a top section arranged spatially separate therefrom, wherein, in the high-pressure column, at least one oxygen-enriched stream is obtainable from at least a part of the feed air, in the low-pressure column at least one argon-enriched stream is obtainable from at least a part of the oxygen-enriched stream, wherein said argon-enriched stream is obtained from a lower part of the top section of the low-pressure column, and in the crude argon column, at least one argon-rich stream is obtainable from at least a part of the argon-enriched stream, a first pipeline for removing at least one liquid stream from a lower region of the top section of the low-pressure column, a second pipeline for removing at least one liquid stream from a lower region of the foot section of the crude argon column, wherein said first pipeline is in direct fluid communication with a shared pump and wherein the second pipeline is in fluid communication with said shared pump, and a third pipeline for transferring the at least one liquid stream from a lower region of the top section of the low-pressure column and the at least one liquid stream from a lower region of the foot section of the crude argon column from the shared pump into an upper region of the foot section of the low-pressure column.

2. The air separation plant as claimed in claim 1, in which the foot section and the top section of the crude argon column are arranged geodetically at least in part next to the top section of the low-pressure column.

3. The air separation plant as claimed in claim 1, in which the foot section or the top section of the crude argon column is arranged geodetically completely above the top section of the low-pressure column.

4. The air separation plant as claimed in claim 1, in which the foot section of the low-pressure column is arranged in vertical plan view next to the top section thereof and/or the foot section of the crude argon column is arranged in vertical plan view next to the top section thereof.

5. The air separation plant as claimed in claim 1, in which the high-pressure column and the foot section of the low-pressure column are arranged in a common cold box.

6. The air separation plant as claimed in claim 1, in which the top section of the low-pressure column and either the foot section or the top section of the crude argon column are arranged in a common cold box.

7. The air separation plant as claimed in claim 6, in which said common cold box is connectable by means of a piping module to further components of the air separation plant.

8. The air separation plant as claimed in claim 1, in which the high-pressure column and the foot section of the low-pressure column are constructed as a structural unit and are in heat-exchange connection to one another via a main condenser.

9. The air separation plant as claimed in claim 1, further comprising a pure argon column, wherein at least one fluid of the pure argon column is coolable by the oxygen-enriched stream.

10. A method for obtaining an argon-containing product by low temperature separation of compressed cooled feed air in an air separation plant, said air separation comprising a high-pressure column, a low-pressure column constructed in multi-part form having a foot section and a top section arranged spatially separate therefrom, and a crude argon column constructed in a multi-part form having a foot section and a top section arranged spatially separate therefrom, said process comprising:

introducing at least a part of the feed air into the high-pressure column and obtaining at least one oxygen-enriched stream from the at least a part of the feed air introduced into the high-pressure column, introducing at least a part of the oxygen-enriched stream into the crude argon column and obtaining at least one argon-enriched stream from at least a part of the oxygen-enriched stream introduced into the crude argon column, wherein said argon-enriched stream is obtained from a lower part of the top section of the low-pressure column, obtaining at least one argon-rich stream from at least a part of the argon-enriched stream, and transferring at least one first liquid stream from a lower region of the top section of the low-pressure column via a first pipeline that is in direct fluid communication with a shared pump, transferring at least one second liquid stream from a lower region of the foot section of the crude argon column via a second pipeline that is in fluid communication with said shared pump, and transferring said first and second liquid streams from said a shared pump to an upper region of the foot section of the low-pressure column via a third pipeline.

11. The method as claimed in claim 10, in which the foot section and the top section of the crude argon column are arranged geodetically at least in part next to the top section of the low-pressure column.

12. The method as claimed in claim 10, in which the foot section or the top section of the crude argon column is arranged geodetically completely above the top section of the low-pressure column.

13. A method for generating an air separation plant, said method comprising:

providing a high-pressure column, a low-pressure column constructed in a multi-part manner having a foot section and a top section, and a crude argon column constructed in a multi-part manner having a foot section and a top section, and providing a shared pump by means of which at least one liquid stream from a lower region of the top section of the low-pressure column and at least one liquid stream from a lower region of the foot section of the crude argon column are directly transferred to an upper region of the foot section of the low-pressure column.

14. The method as claimed in claim 13, in which the foot section and the top section of the crude argon column is arranged geodetically at least in part next to the top section of the low-pressure column.

15. The method as claimed in claim 13, in which the foot section or the top section of the crude argon column is arranged geodetically completely above the top section of the low-pressure column.

16. The air separation plant as claimed in claim 1, in which the foot section or the top section of the crude argon column is arranged geodetically at least in part next to the top section of the low-pressure column.

17. The air separation plant as claimed in claim 1, in which the foot section of the low-pressure column is arranged in vertical plan view next to the top section thereof.

18. The air separation plant as claimed in claim 1, in which the foot section of the crude argon column is arranged in vertical plan view next to the top section thereof.

19. The air separation plant as claimed in claim 10, in which the foot section or the top section of the crude argon column arranged geodetically at least in part next to the top section of the low-pressure column.

20. The method as claimed in claim 13, in which the foot section or the top section of the crude argon column is arranged geodetically at least in part next to the top section of the low-pressure column.

21. The method according to claim 10, wherein said at least one argon-enriched stream is removed from the top section of the low-pressure column.

22. The method according to claim 21, wherein said at least one argon-enriched stream is introduced into the foot section of the crude argon column.

* * * * *